US007029428B2

(12) United States Patent
Hanson, III

(10) Patent No.: US 7,029,428 B2
(45) Date of Patent: Apr. 18, 2006

(54) PELVIC EXTENSION FRAME

(76) Inventor: C. William Hanson, III, 634 E. Lancaster Ave., Radnor, PA (US) 19087

( * ) Notice: Subject to any disclaimer, the term of this patent is extended or adjusted under 35 U.S.C. 154(b) by 458 days.

(21) Appl. No.: 10/394,791

(22) Filed: Mar. 21, 2003

(65) Prior Publication Data

US 2003/0181295 A1 Sep. 25, 2003

Related U.S. Application Data

(60) Provisional application No. 60/366,415, filed on Mar. 21, 2002.

(51) Int. Cl.
*A63B 26/00* (2006.01)

(52) U.S. Cl. ..... 482/105; 482/148

(58) Field of Classification Search ..... 482/148, 482/23, 27–29, 54, 74, 71, 67, 104–108, 482/139; 280/87, 51

See application file for complete search history.

(56) References Cited

U.S. PATENT DOCUMENTS

| | | | | |
|---|---|---|---|---|
| 3,178,851 | A | 4/1965 | Gage | |
| 3,200,536 | A | 8/1965 | Petitto, Sr. | |
| 3,322,425 | A | 5/1967 | Moore | |
| 4,049,264 | A | 9/1977 | Holcombe, Jr. | |
| 4,221,074 | A | 9/1980 | Gonzalez | |
| 4,272,072 | A | 6/1981 | Kusmer | |
| 4,676,502 | A | 6/1987 | Mahr | |
| 4,961,574 | A * | 10/1990 | Lew | 472/17 |
| 6,048,291 | A | 4/2000 | Fisher | |
| 6,056,673 | A * | 5/2000 | Arrecis | 482/66 |

* cited by examiner

*Primary Examiner*—Jerome Donnelly
(74) *Attorney, Agent, or Firm*—Akin Gump Strauss Hauer & Feld, LLP

(57) ABSTRACT

A pelvic extension frame for removable attachment to the waist. The pelvic extension frame comprises a yoke having a first end, a second end, a medial aspect and a longitudinal axis. A harness is connected to the medial aspect of the yoke. A first coupling is connected to the first end of the yoke. The first coupling has a first pivot and a first mount. The first pivot is pivotable about the longitudinal axis. A second coupling is connected to the second end of the yoke. The second coupling has a second pivot and a second mount. The second pivot is pivotable about the longitudinal axis.

1 Claim, 5 Drawing Sheets

PELVIC EXTENSION FRAME

CROSS-REFERENCE TO RELATED APPLICATIONS

This application is related to U.S. Provisional Patent Application No. 60/366,415, filed Mar. 21, 2002, and claims the earlier filing date of the provisional application which is incorporated herein by reference.

BACKGROUND OF THE INVENTION

The present invention relates generally to an exercise aid and more specifically to a pelvic extension frame that is removably attachable around the waist at the level of the iliac crests, which is at the superior aspect of the pelvis and the only point of the pelvis at which a circumferentially attached device does not impede the movement of the legs.

The pelvis is traditionally regarded as the fulcrum of the body. In sports, with few exceptions, athletes rely on pelvic stability and, in many cases, pelvic rotation to convey power to the upper body. Obvious examples include sports such as golf, baseball batting, racquet sports, martial arts, soccer, track and field, etc. Despite a plethora of equipment designed to isolate various portions and muscles of the body, no known device currently exists to isolate the pelvis.

The human gait has been the subject of medical study for centuries and many gait disturbances are specific for various neurological and orthopedic illnesses. The pelvis is the center and fulcrum of the human gait. Acute observation of pelvic motion by a skilled physician can provide key information about the actions of the bones and muscles of the human pelvis. There currently is no known device that amplifies the motion of the pelvis, thereby enhancing the clinician's ability to evaluate the actions of the pelvis. In addition, many lower back disorders relate to splinting or overstressing of the paraspinous and gluteal muscles due to bad posture. A device that amplifies the motion of the pelvis could be used to train individuals to walk properly and thereby reengage muscles that are strained and in pain from constant flexion.

With respect to beauty, while the term "a sexy walk" is part of the common parlance, its definition is analogous to the definition of pornography—"I know it when I see it." Catwalk models are trained to walk in such a way as to exaggerate the motion of the pelvis. There is currently no device that can be used to develop a "sexy walk." By visually amplifying the motions of the pelvis, an individual can be trained to exaggerate the movement of the pelvis and thereby develop a "sexy" walk.

Accordingly, a device, such as the pelvic extension frame disclosed herein, can provide numerous benefits to athletes in a sport-related venue, to patients in a medicine-related venue and to individuals in a beauty-related venue.

BRIEF SUMMARY OF THE INVENTION

Briefly stated, one aspect of the present invention is a pelvic extension frame for removable attachment to the waist. The pelvic extension frame comprises a yoke having a first end, a second end, a medial aspect and a longitudinal axis. A harness is connected to the medial aspect of the yoke. A first coupling is connected to the first end of the yoke. The first coupling has a first pivot and a first mount. The first pivot is pivotable about the longitudinal axis. A second coupling is connected to the second end of the yoke. The second coupling has a second pivot and a second mount. The second pivot is pivotable about the longitudinal axis.

BRIEF DESCRIPTION OF THE SEVERAL VIEWS OF THE DRAWINGS

The foregoing summary, as well as the following detailed description of preferred embodiments of the invention, will be better understood when read in conjunction with the appended drawings. For the purpose of illustrating the invention, there is shown in the drawings embodiments which are presently preferred. It should be understood, however, that the invention is not limited to the precise arrangements and instrumentalities shown.

In the drawings.

DETAILED DESCRIPTION OF THE INVENTION

Figure 1:
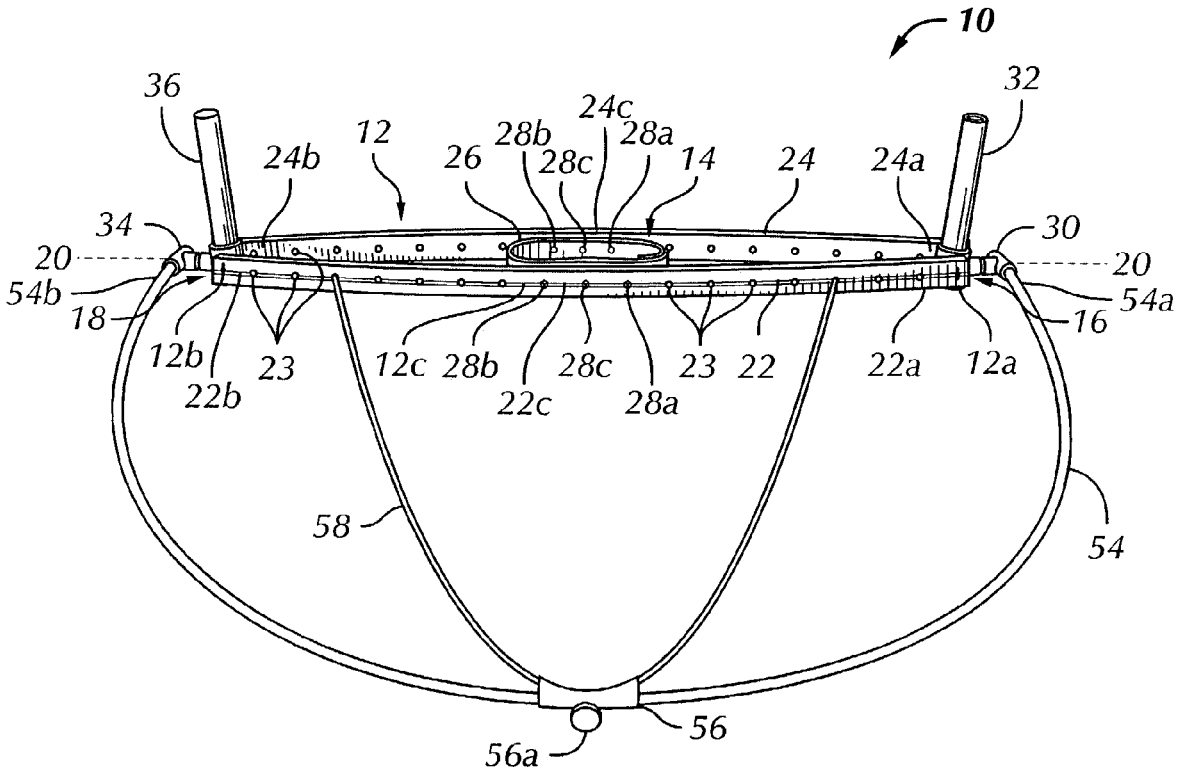
FIG. 1 is a front perspective view of the pelvic extension frame in accordance with a preferred embodiment of the present invention.

Certain terminology is used in the following description for convenience only and is not limiting. The words "right," "left", "lower", "upper", "downwardly" and "upwardly" designate directions in the drawings to which reference is made. The words "inwardly" and "outwardly" refer to directions toward and away from, respectively, the geometric center of a pelvic extension frame and designated parts thereof. The terminology includes the words above specifically mentioned, derivatives thereof and words of similar import.

Additionally, as used in the claims and in the corresponding portion of the specification, the word "a" means "at least one". Further, unless otherwise defined, the word "about" when used in conjunction with a numerical value means a range of values corresponding to the numerical value plus or minus ten percent of the numerical value.

Referring to the drawings in detail, where like numerals indicate like elements throughout, FIGS. 1–5 show a preferred embodiment of the pelvic extension frame, generally designated 10, and hereinafter referred to as the "PEF" 10, in accordance with the present invention. The PEF 10 is a device that is removably attachable to the waist of a user. The PEF 10 is generally comprised of a yoke 12, a harness 14, a first coupling 16 and a second coupling 18.

Figure 2:
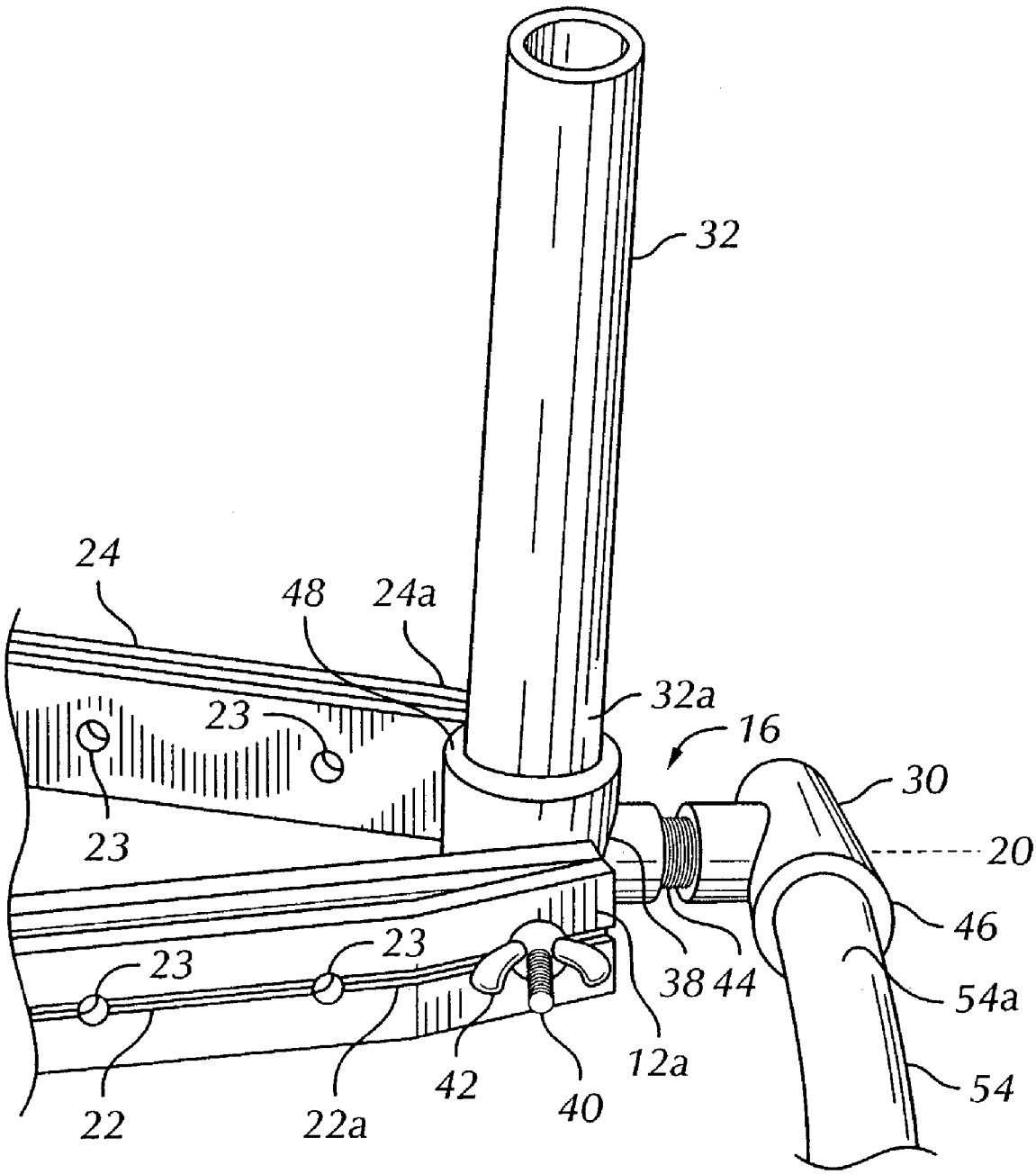
FIG. 2 is an enlarged front perspective view of a first coupling of the pelvic extension frame shown in FIG. 1.
Figure 3:
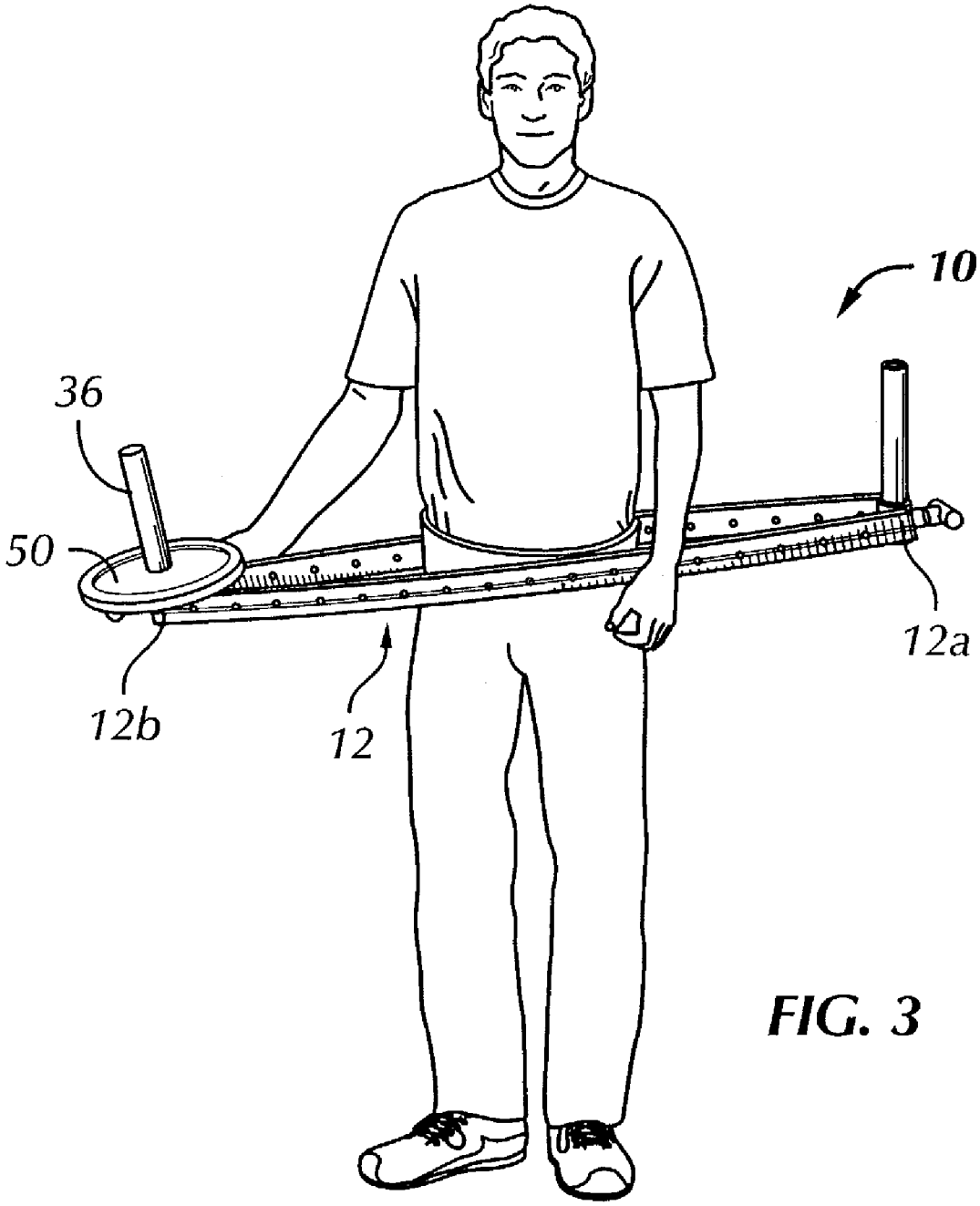
FIG. 3 is a front perspective view of the pelvic extension frame of FIG. 1, in use, with a weight connected to a second mount of a second coupling.

Referring to FIGS. 1 and 2, the yoke 12 has a first end 12*a*, a second end 12*b*, a medial aspect 12*c* and a longitudinal axis 20. The yoke 12 comprises an anterior member 22 and a posterior member 24. The anterior member has a first end 22*a*, a second end 22*b*, and a medial aspect 22*c*. The posterior member 24 has a first end 24*a*, a second end 24*b*, and a medial aspect 24*c*. The first end 22*a* of the anterior member 22 is connected to the first end 24*a* of the posterior member 24 to form the first end 12*a* of the yoke 12. The second end 22*b* of the anterior member 22 is connected to the second end 24*b* of the posterior member 24 to form the second end 12*b* of the yoke 12. The medial aspect 22*c* of the first member 22 and the medial aspect 24*c* of the second member 24 correspond to the medial aspect 12*c* of the yoke 12. The ends 22*a*, 24*a*; 22*b*, 24*b* of the anterior and posterior members 22, 24 may be connected by a variety of well known connection methods such as a nut and bolt, a rivet, a screw, an adhesive, or the like.

Preferably, but not necessarily, the anterior member 22 and the posterior member 24 are about three to four feet long. However, the anterior and posterior members 22, 24 could be more than about three to four feet long or less than about three to four feet long without departing from the scope of the present invention. The anterior member 22 and the posterior member 24 are sufficiently flexible to allow bending in a horizontal plane, thereby permitting the anterior member 22 and the posterior member 24 to have a generally bow-like shape. The separation of the medial aspect 22*c* of the anterior member 22 from the medial aspect 24*c* of the posterior member 24 created by the bow-like shape allows the yoke 12 to be positioned around the waist. The anterior member 22 and the posterior member 24 are sufficiently resistant to bending in a vertical plane to permit the yoke 12 to support a generally downwardly applied force. Preferably, but not necessarily, the anterior and posterior members 22, 24 are constructed of a polymeric material. However, the anterior and posterior members 22, 24 could be fabricated from other materials such as metal or wood without departing from the scope of the present invention.

Figure 5:
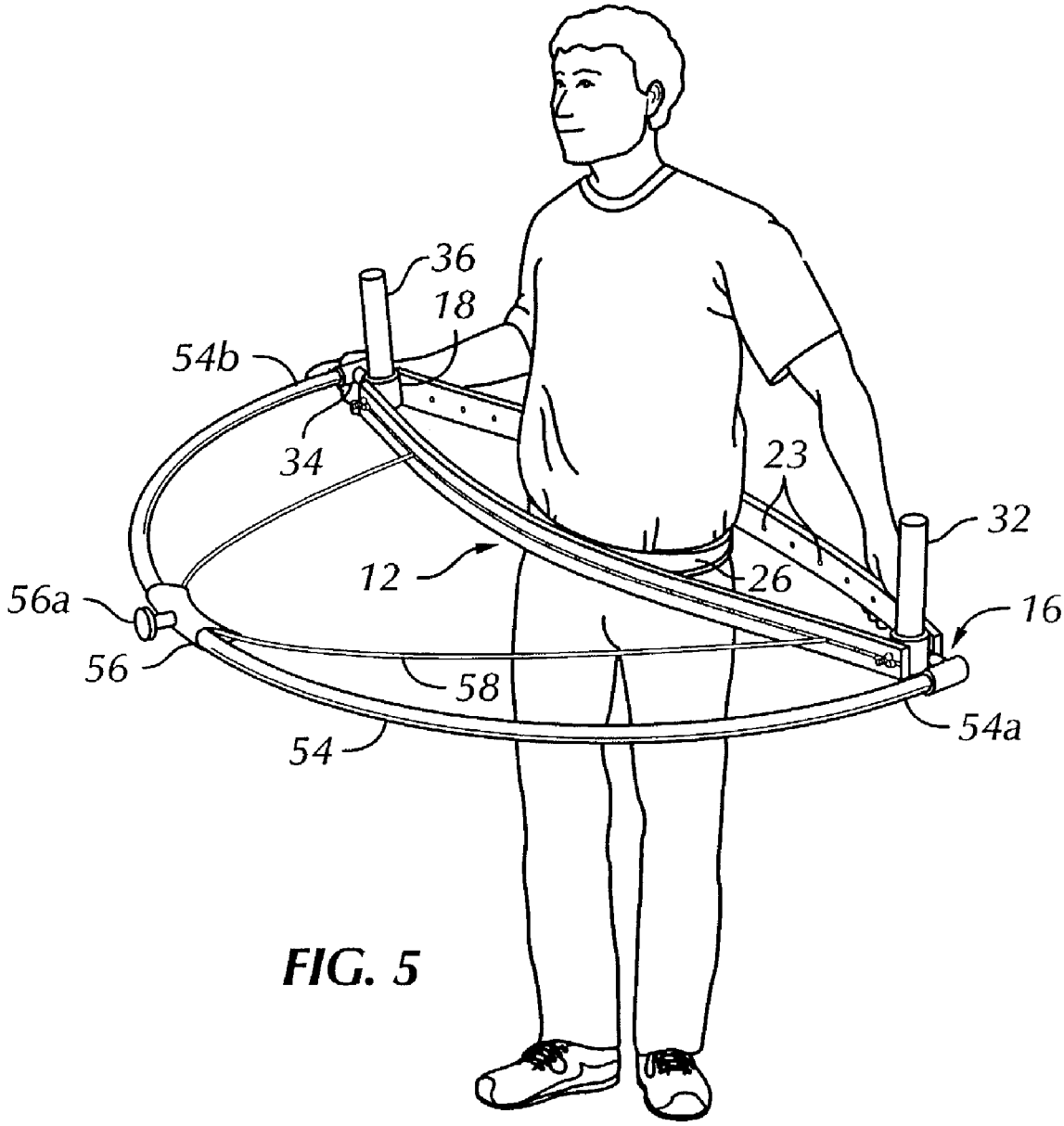
FIG. 5 is perspective view of the pelvic extension frame of FIG. 4, in use, with the rotation frame pivoted toward a front of a user.

Referring to FIGS. 1 and 5, the harness 14 preferably, but not necessarily, comprises a belt 26 that is connected to the medial aspect 22*c* of the anterior member 22 and to the medial aspect 24*c* of the posterior member 24. The anterior member 22 is attached to the belt 26 at the anterior axillary lines 28*a*, 28*b* bilaterally to prevent rotation of the anterior member 22 with respect to the belt 26. Preferably, but not necessarily, the anterior member 22 additionally is attached to the belt 26 at the midline 28*c* to confer further stability to the attachment. The belt 26 may be attached by any of a variety of well known attachment methods such as a nut and bolt, a rivet, a screw, an adhesive or the like. The posterior member 24 is attached to the belt 26 in substantially the same manner as the anterior member 22.

Referring to FIGS. 1 and 2, the first coupling 16 is connected to the first end 12*a* of the yoke 12 and the second coupling 18 is connected to the second end 12*b* of the yoke 12. The first coupling 16 has a first pivot 30 and a first mount 32. The second coupling 18 has a second pivot 34 and a second mount 36. The first and second couplings 16, 18 are substantially the same. Accordingly, for brevity, only the first coupling 16 will be disclosed in detail.

Referring specifically to FIG. 2, the first coupling 16 has a body 38 that is connected to the first end 12*a* of the yoke 12. Preferably, the body 38 of the first coupling 16 is between the first end 22*a* of the anterior member 22 and the first end 24*a* of the posterior member 24 and is attached to the anterior and posterior members 22, 24 by a bolt 40 and wing nut 42 that also connects the anterior member 22 to the posterior member 24. Alternatively, the body 38 could be positioned on either side of the first end 22*a*, 24*a* of the anterior or posterior members 22, 24 without departing from the scope of the present invention. The body 38 could also be attached to the anterior and posterior members 22, 24 by a variety of well-known attachment methods including the methods discussed above. Still further, the body 38 and the anterior and posterior members 22, 24 could be molded or cast as a single part without departing from the scope of the present invention.

The first pivot 30 is pivotably attached to the first coupling 16. Preferably, the first pivot 30 is attached to the body 38 of the first coupling 16 by a shaft 44 that extends outwardly from the body 38. The shaft 44 has an axis coincident with the longitudinal axis 20 of the yoke 12. The first pivot 30 is pivotably attached to the shaft 44 for angular displacement about the longitudinal axis 20. The first pivot 30 preferably has a pivot sleeve 46 for receiving attachments to the first pivot 30, such as a rotational frame 54, as is discussed in detail below. The pivot sleeve 46 extends radially outwardly with respect to the longitudinal axis 20. The first pivot 30 could be configured in various alternate well-known forms such as a hinge, a journal, or a ball-and-socket joint without departing from the scope of the present invention. Further, attachments may be connected to the first pivot 30 by various well known fastening methods including bolts and wing nuts, unions and the like.

Figure 4:
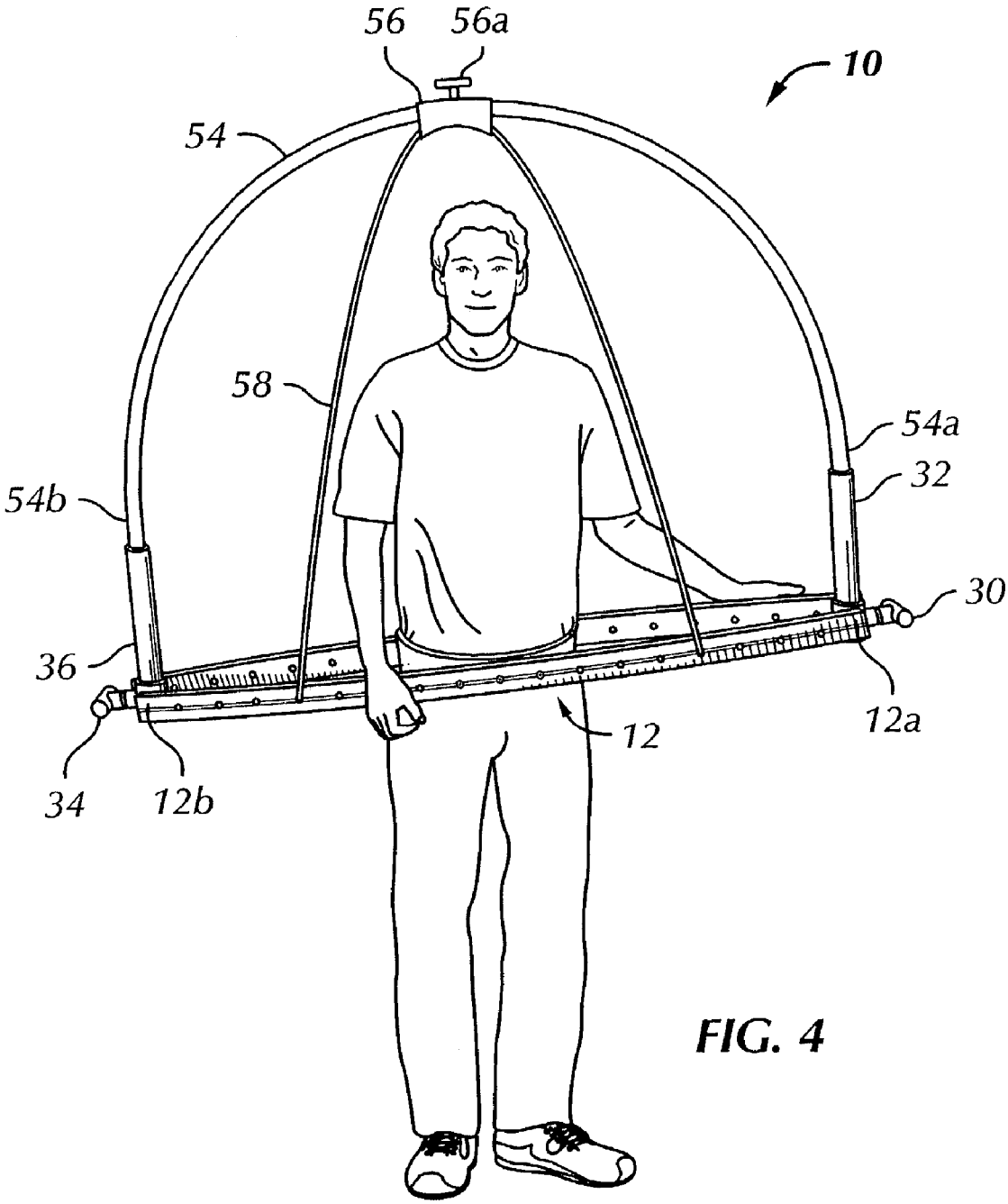
FIG. 4 is a front perspective view of the pelvic extension frame of FIG. 1, in use, with a rotation frame, slider and cable attached thereto.

The first mount 32 is attached to the first coupling 16. Preferably, the first mount 32 has a generally tubular shape and is attached to the body 38 of the first coupling 16 by a first end 32*a* that is inserted in a mounting sleeve 48 in the body 38 and adhesively secured therein. The first mount 32 extends generally upwardly from the body 38 and is for receiving attachments to the yoke 12. For example, attachments that apply a downwardly directed force to the yoke 12, such as a weight 50 (FIG. 3) or an elastic resistance band (not shown) may be removably attached to the first or second mount 32, 36. Other devices, such as the rotational frame 54 discussed below can also be attached to the first and second mounts 32, 36 as shown in FIG. 4. The first mount 32 (and the second mount 36) may alternatively comprise one of a variety of well known method for attaching a device to the yoke 12, such as a hook, a clasp, a strap or a tie, without departing from the scope of the present invention, FIGS. 1, 2, 4 and 5 show the rotational frame 54 having a first end 54*a* that is removably connected to the first pivot 30 of the first coupling 16 and a second end 54*b* that is removably connected to the second pivot 34 of the second coupling 18. Preferably, the rotational frame 54 is a generally arcuate-shaped tube having a circular cross-section. The first end 54*a* of the rotational frame 54 preferably is removably insertable in a friction fit in the pivot sleeve 46 of the first pivot 30. The second end 54*b* of the rotational frame 54 is attached in substantially the same manner to the second pivot 34. Alternatively, the rotational frame 54 may be removably secured to the PEF 10 by securing its first and second ends 54*a*, 54*b* to the first and second mounts 32, 36 (FIG. 4). The rotational frame 54 preferably has a slider 56 that slideably engages the rotational frame 54 and is movable along the frame in response to an angular acceleration. Those skilled in the art will understand that the mass of the slider 56 can be changed to any desired mass without departing from the scope of the invention. One purpose of the rotational frame 54 and slider 56 is to provide a visual cue as feedback to motion imparted to the yoke 12 by movement of the pelvis of a user. Accordingly, the rotational frame 54 may have a plurality of shapes, each of which allows a slider 56 or other visual cue, such as a streamer or light wand, to trace a space curve corresponding to the movement of the pelvis or audible cues such as a bell to provide audible feedback as to the symmetry of hip movement without departing from the scope of the present invention.

Referring to FIGS. 1, 4 and 5, in a preferred embodiment of the PEF 10, a cable 58 is secured between the yoke 12 and the rotational frame 54. To accommodate the cable 58, the yoke 12 includes holes 23 disposed therethrough. The holes 23 are preferably dispersed along the length of the yoke 12 such that the position of the attachment of the cable 58 may be adjusted to adjust a predetermined slider position or a friction force between the slider 56 and rotational frame 54, as is described in greater detail below. The holes 23 may also serve as points for receiving attachments that applying a downwardly directed force such as the weights or elastic resistance bands discussed above. The cable 58 is not limited to being secured to two positions on the yoke 12 as is shown in the Figures and may be secured to the yoke 12 at one or more positions along the yoke 12, for example, at the medial aspect 22*c*, 24*c* of the anterior or posterior members 22, 24. The cable 58 preferably has an elastic construction and is arranged such that the slider 56 is biased to a predetermined position along the length of the rotational frame 54. Accordingly, as a user accelerates the PEF 10, the slider 56 moves away from the predetermined position as the cable 58 urges the slider 56 toward the predetermined position.

In addition to biasing the slider 56 toward the predetermined position, the cable 58 may be arranged to adjust the friction between the slider 56 and rotational frame 54. Specifically, the greater the elastic force that the cable 58 exerts on the slider 56, the greater the frictional force between the slider 56 and the rotational frame 54. For example, the attachment of the cable 58 to the yoke 12 may be adjusted to alter the force exerted by the cable on the slider 56, thereby altering the friction force between the slider 56 and the rotational frame 54. Alternatively, the friction between the slider 56 and the rotational frame 54 may be mechanically adjusted using a friction adjust knob 56*a* that directly applies an adjustable friction force to the rotational frame 54. The cable 58 is not limited to elastic constructions and may be constructed of nearly any material that may be secured between the yoke 12 and slider 56 and guides the slider 56 in its movement along the length of the rotational frame 54. In addition, the cable 58 may be secured to the yoke 12 and slider 56 in numerous fashions that are obvious to one having ordinary skill in the art.

The PEF 10 is a device that translates the movements of the pelvis to a mechanical. frame attached to the body at the waist. The PEF 10 can be used in various ways, for example, the first and second ends 12*a*, 12*b* of the yoke 12 are equipped with first and second couplings 16, 18 by which the yoke 12 can be (i) loaded with weights or elastic resistance bands, (ii) attached to devices designed for aerobic exercise of the muscles attached to the pelvis, (iii) attached to devices designed to train the user in the speed of rotation of the pelvis, and (iv) attached to devices used as visual cues regarding the action of the pelvis for medical and non-medical applications. Examples of some of the ways that the PEF 10 can be used are discussed below.

In use, the PEF 10 is placed around the waist at the level of the iliac crests such that the waist is between the anterior and posterior members 22, 24 and such that the first and second ends 12*a*, 12*b* of the yoke 12 extend outwardly from the left and right sides of the user. The PEF 10 is secured to the waist by cinching the belt 26 attached to the yoke 12.

The PEF 10 can be used to load the pelvis symmetrically or asymmetrically, and thereby load the muscles attached to the pelvis as well as those of the lower extremities. For example, referring to FIGS. 3, the PEF 10 is shown in use with a weight 50 to asymmetrically load specific target muscles. Alternatively, to asymmetrically load specific targeted muscles, the PEF 10 may be loaded by an elastic resistance band secured to one of the first or second ends 12*a*, 12*b* of the yoke 12. One possible method by which a user may use the elastic resistance band to apply a downwardly directed load to the yoke 12 is to pass the band under the user's foot, grasp the free end with a hand and apply an upwardly directed force to the free end, thereby placing the band in tension.

The PEF 10 can also be used as a visual cue amplifying the actions of the pelvis. Referring to FIGS. 4 and 5, the PEF 10 is shown in use with the rotational frame 54 in either the horizontal or vertical position. Acceleration of the PEF 10 due to a twisting or rocking movement of the pelvis is visually confirmed by the sliding motion of the slider 56 along the rotational frame 54. In addition, the magnitude of the user's twisting or rocking movement may be visually indicated by the movement of the slider 56 in comparison to a selected frictional force applied between the slider 56 and rotational frame 54. That is, a user may adjust the frictional force by altering the elasticity of the cable 58, the attachment of the cable 58 to the yoke 12 and/or the friction adjust knob 56*a*.

It will be appreciated by those skilled in the art that changes could be made to both the embodiments described above and the use of the described embodiments without departing from the broad inventive concept thereof. It is understood, therefore, that this invention is not limited to the particular embodiments disclosed, but it is intended to cover modifications within the spirit and scope of the present invention as defined by the appended claims.

I claim:

1. A pelvic extension frame for removable attachment to the waist, the pelvic extension frame comprising:

a yoke having a first end, a second end, a medial aspect and a longitudinal axis;

a harness connected to the medial aspect of the yoke;

a first coupling connected to the first end of the yoke, the first coupling having a first pivot and a first mount, the first pivot pivotable about the longitudinal axis;

a second coupling connected to the second end of the yoke, the second coupling having a second pivot and a second mount, the second pivot pivotable about the longitudinal axis;

an application specific device connected to at least one of the first coupling and the second coupling, wherein the application specific device is a rotational frame having a first end removably connected to the pivot of the first coupling and a second end removably connected to the pivot of the second coupling;

a slider slidably secured to the rotational frame; and a cable secured between the slider and yoke.

* * * * *